United States Patent [19]

Quinn

[11] 4,168,788

[45] Sep. 25, 1979

[54] CLOSURE CAP AND DISPENSER BODY ASSEMBLY

[75] Inventor: David R. Quinn, Pembroke Pines, Fla.

[73] Assignee: The AFA Corporation, Miami Lakes, Fla.

[21] Appl. No.: 923,879

[22] Filed: Jul. 12, 1978

[51] Int. Cl.[2] ..... B05B 11/04

[52] U.S. Cl. ..... 222/383; 222/482; 239/333

[58] Field of Search ..... 239/333; 222/207, 214, 222/383, 385, 478, 482

[56] References Cited

U.S. PATENT DOCUMENTS

| | | | |
|---|---|---|---|
| 3,520,452 | 7/1970 | Malone | 222/340 X |
| 3,685,739 | 8/1972 | Vanier | 239/333 |
| 3,753,518 | 8/1973 | Kutik | 222/383 |
| 3,780,951 | 12/1973 | Powers | 239/333 |
| 3,897,006 | 7/1975 | Tada | 222/384 X |
| 4,088,248 | 5/1978 | Blake | 222/207 |

*Primary Examiner*—David A. Scherbel

*Attorney, Agent, or Firm*—Stanley A. Marcus; William R. Wright, Jr.

[57] ABSTRACT

A dispenser body and a closure cap assembly for a container is presented which provides not only a closure for the container, except for communication with the dispenser, but also provides an air inlet operable upon the withdrawal or expulsion of the contents of the container so that air will be replenished therein to restore normal air pressure. The air inlet closes automatically when this has been accomplished to prevent leakage of the contents of the container.

12 Claims, 4 Drawing Figures

CLOSURE CAP AND DISPENSER BODY ASSEMBLY

BACKGROUND OF THE INVENTION AND DISCUSSION OF THE PRIOR ART

Sprayer and other hand-operated pump type dispensers, as well as squeeze bottle dispensers, are well known in the art but all are involved with the problem of replenishing the air within the container as the contents are expelled so as to restore normal atmospheric pressure and also to prevent inward collapse of the container because of low internal pressure. Various ways of solving this problem have been presented in the past but they fall short of accomplishing this purpose by allowing leakage of the contents through the vent means which is undesirable for many reasons including the safety of the user where the contents may be toxic or injurious to the skin. Even leakage of a fluid such as water is undesirable since it could damage furniture or clothing. Attempts to solve this problem also tend to present devices which become complex, difficult to make and expensive. Also, they may require an additional operation by the user to open or close the vent which not only represents a nuisance to the user but can easily be forgotten with a resultant spill. Applicant, however, solves these problems by providing a completely automatic one-way vent seal which can be expected to seal effectively without attention by the user of the device and yet will open upon demand of a lowered pressure within the container. It is also simple, easy to make and should be relatively inexpensive to manufacture.

An important feature of the present invention is the control of the extent of the maximum vent valve opening which is established in the manufacture of the assembly of cap and body. The maximum opening thereafter remains the same and is completely independent of the degree of tightening which a user may apply to the cap unless, of course, the cap becomes actually distorted due to excessive over tightening which is an unlikely occurrence with the usual hand tightening.

In the art, several patents show various arrangements designed to achieve the venting of the container's interior. For instance, U.S. Pat. No. 3,685,739 to Vance R. Vanier includes a typical sprayer attached to a container for liquids by means of a screw cap which clamps the sprayer to the container with a gasket or sealing washer therebetween. This gasket extends in a frusto-conical form downwardly therefrom with its lower edge touching the stem of the body inside the neck of the container and providing a seal. An air passage allows access of air into the interior of the cone and this air exerts itself upon the seal, and, when the air pressure inside the container becomes less than the outside air, the seal deflects away from the stem of the body and allows air to enter the container. The present invention, however, differs from this showing in several ways including the fact that applicant's seal is unitary with the cap and does not represent a separate part which may become separated from the cap and lost. Also, the seal provided in the present invention makes it unnecessary to use rubber which may be incompatible with the particular liquid in the container and cause the rubber to swell, rot or otherwise lose its shape and resiliency and thus cause it to lose its ability to seal and vent properly. The location of the seal of the present invention outside of the neck of the container also alleviates this problem because of the remoteness of the seal from the liquid in the container.

Another U.S. Pat. No. 3,780,951 to Richard T. Powers includes a dispenser held to a container by a screw cap with a gasket between the body of the dispenser and the rim of the container. The vent here includes a collar on the dispenser body which is screwed down by the operator to close a vent passage and is unscrewed to open it. It is not automatic in action as is the vent device of the dispenser in the present invention and is manually operated.

Another U.S. Pat. No. 3,587,940 to Roy T. Ellis shows a frusto-conical seal member generally similar to that of the Vanier patent mentioned above, except that sealing occurs nearer the base of the frusto-cone. This arrangement also has the inherent disadvantages of the Vanier showing as is also the case with respect to French Pat. No. 1,577,522/1969 to Rene' Fedit et al.

Another U.S. Pat. No. 3,897,006 to Tetsuya Tada shows a vent valve which is inside of the dispenser body and is part of an inner sleeve and not part of the cap itself. In addition, the valve is mechanically operated by manual manipulation of the pump mechanism to push the valve seal off its seat by means of a slender rod.

Another U.S. Pat. No. 3,927,834 to Tetsuya Tada shows a vent passage in the dispenser body plugged by a trigger catch which unblocks the passage when the catch is removed from the trigger. Similarly, in the U.S. Pat. No. 3,726,442 to Thomas N. Davidson et al, a stem attached to the hinged upper part of the sprayer body blocks and unblocks a vent passage as the sprayer is operated through its operating cycle.

Another U.S. Pat. No. 3,749,290 to Lewis A. Micallef shows a trigger sprayer wherein the trigger is arranged to squeeze a pumping member which moves away from the body to open a vent passage. Also, the U.S. Pat. No. 3,986,644 to Richard P. Grogan shows a trigger-operated dispenser which squeezes its pumping member and moves it away from the dispenser body to open a vent passage.

None of the above-mentioned patents show the vent seal member as part of the cap itself nor do they show the novel combination of the present invention including the controlled maximum vent opening.

OBJECTS OF THE INVENTION

It is, therefore, an object of the present invention to provide a cap and dispenser body assembly, for attachment to a container, which both closes the container except to the interior of the dispenser and provides a one-way automatic vent to allow air to enter the container upon demand with the sealing member of the vent attached only to the cap.

It is also an object of the present invention to provide a cap and dispenser body assembly of the foregoing type wherein the extent of the maximum vent seal opening is constant due to dimensional control during manufacture of the device and is thereafter independent of how much the cap is tightened on the container.

It is also an object of the present invention to provide a cap and dispenser body assembly of the foregoing type wherein the sealing member of the vent is integral with the cap and therefore cannot be detached from the cap and lost.

It is also an object of the present invention to provide a cap and dispenser body assembly of the foregoing type wherein the vent seal is not directly exposed to the interior of the container and thus is not directly exposed to the contents thereof.

Another object of the present invention is to provide a cap and dispenser body assembly of the foregoing type which is simple, easy to make and relatively inexpensive.

Other objects and advantages of the present invention will be apparent from the description and claims which follow.

IN THE DRAWINGS

DETAILED DESCRIPTION OF THE INVENTION

Figure 1:
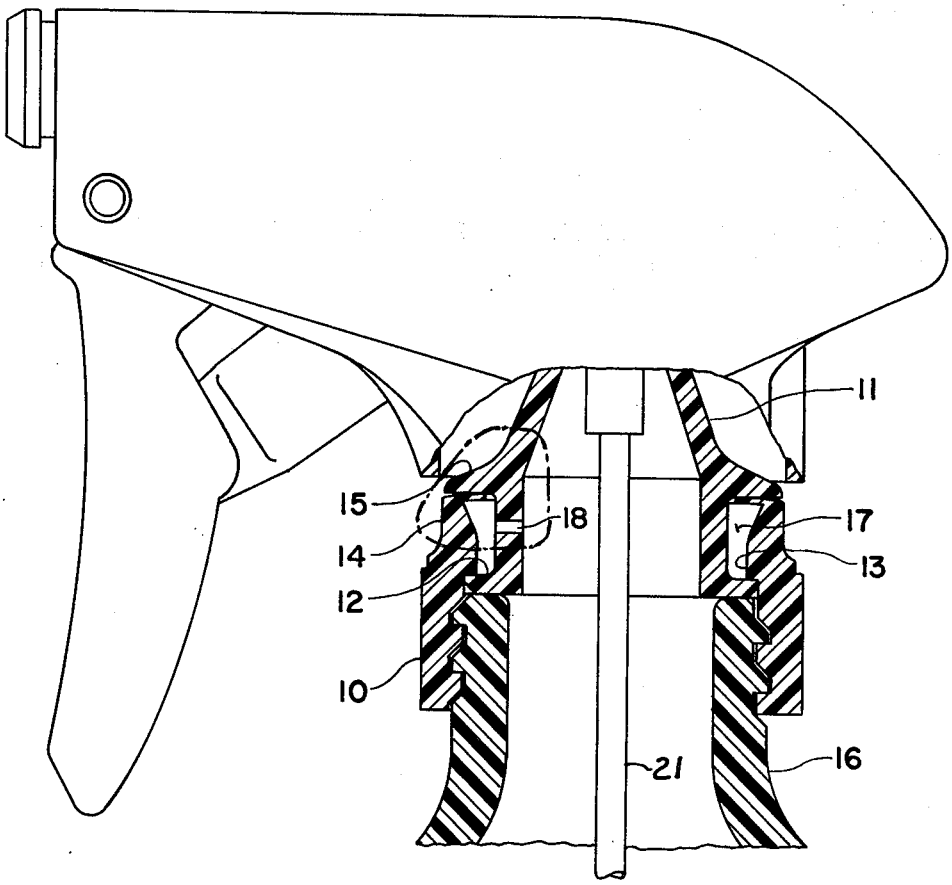
FIG. 1 is a front elevational view of a typical hand-operated sprayer dispenser and container with the dispenser's body and cap assembly mounted on the container in the fully operative position. The cap and body assembly portion and the container's neck are shown in cross-section.
Figure 2:
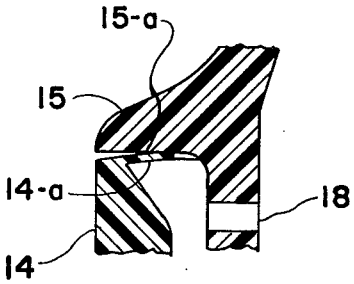
FIG. 2 is an enlarged view of the juncture between the cap and body shown in the broken line circled area of FIG. 1.
Figure 3:
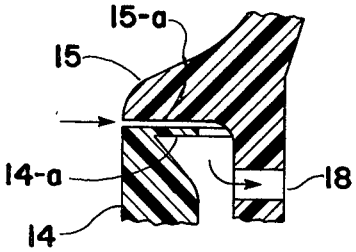
FIG. 3 is an enlarged view of the juncture between the cap and body shown in the broken line circled area of FIG. 2 and showing the vent seal in its deflected or open position during the periods when the air pressure has been reduced in the container below atmospheric pressure.

In a preferred embodiment of the present invention and with particular reference to FIG. 1 of the drawings, a cap or closure 10 is located on the lower end of dispenser body 11 and is retained thereon by the overlapping interference of annular lip 12 on body 11 and annular lip 13 on the inside of cap 10. The cap 10 is free to rotate with respect to body 11. As will be seen in the drawings, cap 10 has an upper annular wall or extension 14 extending upwardly and terminating in a thin flat, annular seal ring **14*a* which extends inwardly of the wall 14 and which slants upwardly toward its inner periphery in its normal condition with the cap 10 and body 11 unassembled but is deflected upon their assembly to assume the shape shown in FIGS. 1 and 2**.

The body 11 has an annular flange 15 extended outwardly from its side and has a substantially smooth and flat under surface or sealing face **15*a*. The flange 15 is located on body 11 at a height which brings its sealing face 15*a* just above the top of wall 14 when cap 10 is in place on container 16, and, the flange 15 is sufficiently large in diameter to overlap seal 14*a* at least where seal 14*a* and seal face 15*a* come into contact. The space or gap between flange 15 and the top of wall 14 is predetermined by the dimensioning of these parts during their manufacture so that, upon assembly, the gap establishes the maximum amount of opening which the vent valve can attain and also assures that a gap is present. The gap establishes the extent of the deflection of lip seal 14*a* when the cap 10 and body 11 are assembled and thus determines how easily lip 14*a* will move away from its seat under the influence of a slight atmospheric pressure differential. This gap cannot change appreciably due to normal differences in tightening of the cap 10 but remains substantially constant as long as the cap 10 is in place. The actual amount of opening of the vent valve is determined by the movement of valve lip seal 14*a*** as explained later but maximum opening is determined by this gap.

As previously stated, upper wall or extension 14 extends upwardly as described but it also defines a space or chamber 17 between itself and dispenser body 11. Chamber 17 is in communication with the interior of body 11 and container 16 by means of a communicating passage 18 which extends through the wall of body 11 as shown in FIG. 1.

Figure 4:
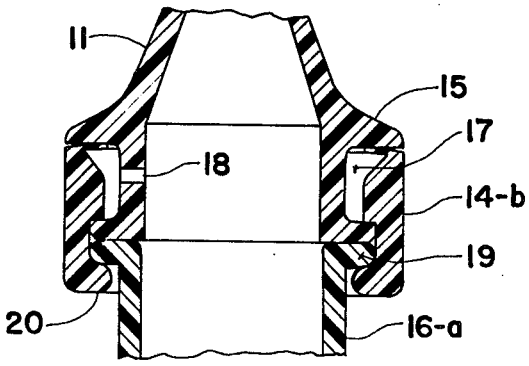
FIG. 4 is a front elevational cross sectional view of the present invention as modified to include a "snap on" cap to a suitable container.

As also will be seen in FIG. 1, the cap 10 has threads on its interior which mate with similar threads on the neck of container 16 so that cap 10 can be screwed down thereon in the usual manner of a screw cap. Other arrangements may also be employed to fasten the cap 10 to the top of the container 16 such as the "snap on" arrangement shown in FIG. 4 wherein the cap and the container are configured as shown to cooperate in a snap effect by the annular ridge of the cap overriding annular ridge of the container **16*a*. The dimensions of the cap and container ridges are such that annular rim 12 is forced down tightly against the top of container 16*a* to effect a fluid tight seal between those parts and thus close the container except for communication to the dispenser through the dip tube 21. The upper portion of the cap 10 and body 11 are identical with the configuration shown in FIG. 1**.

It is necessary that at least the cap 10 and seal **14*a* be made of a material which has some resiliency so that seal 14*a*** will always return to its initial position in a positive manner but yet will deflect easily with a slight pressure differential. A number of plastic materials are suitable including, but not necessarily limited to, polypropylene and polyethylene.

OPERATION OF THE INVENTION

With reference to the preferred embodiment of the invention shown in FIG. 1 of the drawings, the cap 10 and the dispenser body 11 are first assembled, usually at the factory, by forcing body 11 down into the cap 10 until the rim 12 on body 11 snaps into place under lip 13 on the cap 10. As this occurs, lip seal **14*a* presses against sealing face 15*a* of flange 15 and this deflects lip 14*a* downward sufficiently to effect a fluid tight seal at the area of contact. The cap 10 is then screwed down on the neck of container 16 until rim 12 is in sufficiently firm contact with the rim of the neck of container 16** to effect a fluid tight seal therebetween.

With the cap thus in place, the two seals just described prevent leakage of fluid from the container 16. However, when the dispenser is operated, such as by pumping of the sprayer, the pressure of the air inside container 16 becomes lower than the outside air with the result that valve lip **14*a* is automatically deflected and forced away from sealing face 15*a* by the pressure force of the outside air after which air passes between lip 14*a* and face 15*a* into chamber 17 and through passage 18 into the container 16. This valve action relieves the unbalanced pressure condition between the interior and exterior of container 16** and thus prevents collapse of the container and insures proper operation of the dispenser.

When the pressure unbalance has been relieved, lip **14*a* automatically returns, under the force of its own resiliency, to contact face 15*a* and thus once again to effect a fluid tight seal between it and face 15*a***.

While there have been shown and described and pointed out the fundamental novel features of the invention as applied to a preferred embodiment, it will be understood that various omissions and substitutions and changes in the form and details of the device illustrated and in its operation may be made by those skilled in the art, without departing from the spirit of the invention. It is the intention, therefore to be limited only as indicated by the scope of the following claims.

What is claimed is:

1. A closure cap for the outlet of a fluid container associated with the body of a dispenser wherein the cap and the body are permanently retained together as an assembly, means on said cap permitting its attachment to the container, means adapted to seal the outlet of the container when the cap is attached to the container, valve means on said cap and seating upon said body to permit fluid flow into but not out of the container with said valve means in communication with the container's interior and the outside air, and said valve means responsive to sub-atmospheric air pressure within the container to admit atmospheric air into the container.

2. The invention set forth in claim 1 with the valve means comprising an annular lip seal attached to the cap and bearing against the body.

3. The invention set forth in claim 2 with the lip seal attached to an extension of the cap and bearing upon an outwardly extended flange on the body.

4. The invention set forth in claim 3 with the flange having a substantially smooth and flat bearing surface where the lip seal bears upon it.

5. The invention set forth in claim 3 with the extension of the cap integral with the cap.

6. The invention set forth in claim 3 with the lip seal integral with the cap.

7. The invention set forth in claim 6 with both the lip seal and extension integral with the cap.

8. The invention set forth in claim 3 with the lip seal extended from and integral with the extension of the cap.

9. The invention set forth in claim 3 with the space between the cap and the flange predetermined upon assembly of the cap and body.

10. The invention set forth in claim 2 with the lip seal slanted toward the body.

11. The invention set forth in claim 2 with the lip seal slanted toward the body and deflected by the body where it bears upon it.

12. The invention set forth in claim 1 with the dispenser comprising a sprayer.

* * * * *